US011073277B2

(12) United States Patent
Merritt et al.

(10) Patent No.: US 11,073,277 B2
(45) Date of Patent: Jul. 27, 2021

(54) STANDS FOR SUPPORTING A PLURALITY OF CANDLES OR DECORATIONS

(71) Applicants: William Merritt, Mercer Island, WA (US); Carey Ide, Hudson, WI (US)

(72) Inventors: William Merritt, Mercer Island, WA (US); Carey Ide, Hudson, WI (US)

( * ) Notice: Subject to any disclaimer, the term of this patent is extended or adjusted under 35 U.S.C. 154(b) by 77 days.

(21) Appl. No.: 16/445,535

(22) Filed: Jun. 19, 2019

(65) Prior Publication Data

US 2019/0383483 A1 Dec. 19, 2019

Related U.S. Application Data

(60) Provisional application No. 62/686,970, filed on Jun. 19, 2018.

(51) Int. Cl.
*F21V 35/00* (2006.01)
*F21W 121/00* (2006.01)

(52) U.S. Cl.
CPC ..... *F21V 35/00* (2013.01); *F21W 2121/002* (2013.01)

(58) Field of Classification Search
CPC ..... E04H 3/12; E04H 3/14; E04H 3/22; A47F 5/04; A01G 9/023; F21V 35/00; F21W 2121/002
See application file for complete search history.

(56) References Cited

U.S. PATENT DOCUMENTS 2,003,876 A * 6/1935 Birtcher ..... E04F 11/025 182/93
5,570,540 A * 11/1996 Womack ..... A47G 7/041 211/186
2009/0211154 A1* 8/2009 DiMaggio ..... A01G 9/023 47/83
2016/0222673 A1* 8/2016 Brink ..... E04F 11/104

FOREIGN PATENT DOCUMENTS

JP 10043040 A * 2/1998
JP 10227110 * 8/1998

* cited by examiner

*Primary Examiner* — Jason Lau

(57) ABSTRACT

Stands for supporting a plurality of candles or decorations around a celebratory item, including a stringer and a platform supported on the stringer, the platform being complementarity configured with the celebratory item and including a plurality of support points configured to support the plurality of candles or decorations. In some examples, the stand includes a first stringer and a second stringer horizontally spaced from the first stringer, a first platform supported by the first stringer and the second stringer, and a second platform supported by the first stringer and by the second stringer in a position vertically spaced from the first platform, wherein the first platform and the second platform each include a plurality of support points configured to support the plurality of candles or decorations and are complementarity configured with the celebratory item to support the plurality of candles or decorations in a position adjacent to the celebratory item.

6 Claims, 4 Drawing Sheets

STANDS FOR SUPPORTING A PLURALITY OF CANDLES OR DECORATIONS

CROSS REFERENCE TO RELATED APPLICATIONS

This application claims priority to U.S. application Ser. No. 62/686,970, filed on Jun. 19, 2018, which is hereby incorporated by reference for all purposes.

BACKGROUND

The present disclosure relates generally to stands. In particular, stands for supporting a plurality of candles or decorations are described.

Birthdays, anniversaries, and other special events are a time to celebrate and enjoy food and company. Often times, these occasions are celebrated with celebratory items, such as food, flowers, pictures, trophies, and memorabilia. Common celebratory food items include cake, cupcakes, and pies ornately decorated with frosting and figurines. Other foods people use to celebrate occasions include pizza, fruit, tacos, hamburgers, and other foods with significance in a given culture or region. The aesthetic aspects of the decorated food are often valued as much or more than the taste of the food.

With celebratory food, candles are often inserted into the food and lit to increase the spectacle of the food and as part of rituals involving blowing out the candles. For birthday and anniversary celebrations, the number of candles placed in celebratory food, such as a birthday cake or an anniversary cake, often has significance, such as representing the number of years being celebrated.

Placing candles or decorations in food can ruin the food's decoration and may even pose a health hazard for people eating the food. When candles are utilized with celebratory food, they are often inserted directly into the food, such as inserted through the frosting and into the body of a cake. Inserting candles or decorations into food tends to obscure or ruin the decoration of the food.

Candles inserted into food create issues beyond diminishing the aesthetics of the food. For example, candle wax from lit candles may drip onto the food, which may decrease the appeal of the food and create a risk that the candle wax will be ingested by someone served the food. Further, when the person being celebrated blows out the candles, he or she may inadvertently spread germs onto the food that is later consumed, possibly spreading sickness and disease. See Dawson, Paul, *Bacterial Transfer Associated with Blowing Out Candles on a Birthday Cake*, Journal of Food Research Vol. 6, No. 4 (2017).

Thus, there exists a need for solutions to utilize candles and other decorations with celebratory foods that improve upon and advance the design of known methods of using candles and decorations with celebratory foods, such as inserting candles and decoration into the top of celebratory foods. Examples of new and useful stands for supporting a plurality of candles or decorations relevant to the needs existing in the field are discussed below.

SUMMARY

The present disclosure is directed to stands for supporting a plurality of candles or decorations around a celebratory item, including a stringer and a platform supported on the stringer, the platform being complementarily configured with the celebratory item and including a plurality of support points configured to support the plurality of candles. In some examples, the stand includes a first stringer and a second stringer horizontally spaced from the first stringer, a first platform supported by the first stringer and the second stringer, and a second platform supported by the first stringer and by the second stringer in a position vertically spaced from the first platform, wherein the first platform and the second platform each include a plurality of support points configured to support the plurality of candles or decorations and are complementarily configured with the celebratory item to support the plurality of candles or decorations in a position adjacent to the celebratory item.

DETAILED DESCRIPTION

The disclosed stands will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various stands are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

Definitions

The following definitions apply herein, unless otherwise indicated.

"Substantially" means to be more-or-less conforming to the particular dimension, range, shape, concept, or other aspect modified by the term, such that a feature or component need not conform exactly. For example, a "substantially cylindrical" object means that me object resembles a cylinder, but may have one or more deviations from a true cylinder.

"Comprising," "including," and "having" (and conjugations thereof) are used interchangeably to mean including but not necessarily limited to, and are open-ended terms not intended to exclude additional, elements or method steps not expressly recited.

Terms such as "first", "second", and "third" are used to distinguish or identify various members of a group, or the like, and are not intended to denote a serial, chronological, or numerical limitation.

"Coupled" means connected, either permanently or releasably, whether directly or indirectly through intervening components.

Celebratory Item

Figure 1:
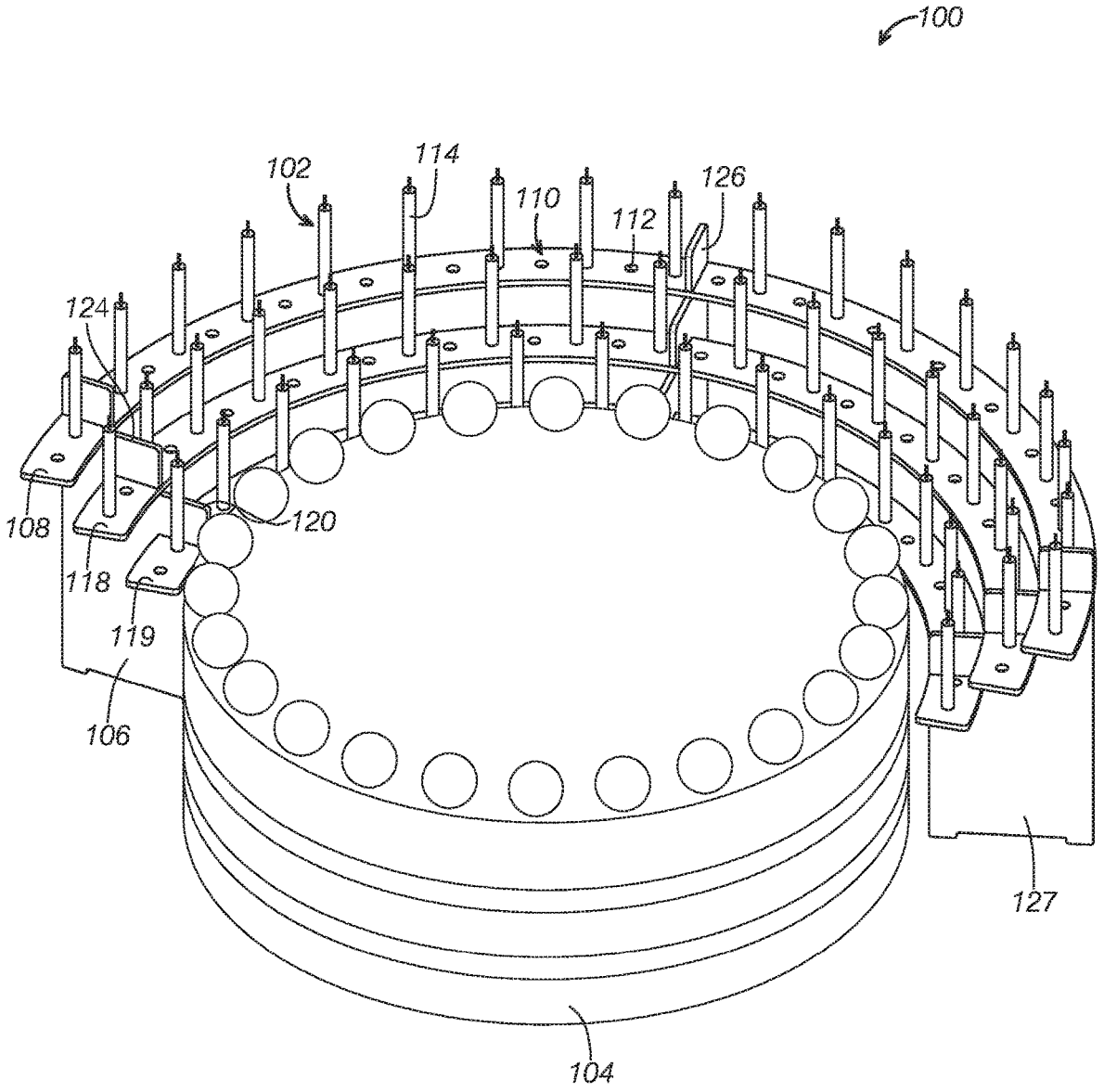
FIG. 1 is a perspective view of a stand for supporting a plurality of candles around a cake, the stand including three platforms supported on three stringers.

With reference to FIG. 1, the features of a celebratory item 104 will first be described to aid the discussion of the stands disclosed herein. As will be described in more detail below, the presently disclosed stands are configured to support a plurality of candles or other decorations proximate a celebratory item.

In the present example, celebratory item 104 is a decorated cake. In other examples, the celebratory item is another type of celebratory food item, such as cupcakes, pies, cookies, donuts, pizza, fruit, tacos, hamburgers, and other foods with significance in a given culture or region. Celebratory foods are often decorated, but need not be in every instance. In some examples, the celebratory item is a non-food item, such as flowers, pictures, trophies, and memorabilia.

As can be seen in FIG. 1, celebratory item 104 approximates the shape of a cylinder with a curved or round outer profile, a circular base, and a circular top. In other examples, the celebratory item adopts other shapes, such as triangular, oval, cubic, blockish, planar (such as with sheet cakes), toroidal, spherical, or irregular. In some examples, the celebratory item resembles a fictional character, a person, a building, or text.

Candles or Decorations

As shown in FIG. 1, a plurality of candles 102 is supported on a first example of a stand proximate celebratory item 104. In the present example, plurality of candles 102 includes 50 individual candles 114. In other examples, more or fewer candles are present.

In other examples, the stand supports decorations in addition to candles or instead of candles. Other suitable decorations suitable to be supported by the stands disclosed herein include ornaments, figurines, pictures, tassels, streamers, crepe paper, party hats, and the like.

As shown in FIG. 1, candles 114 are cylindrical in shape and have a curved outer profile. The candles may be any currently known or later developed shape or type of candle.

Stands for Supporting a Plurality of Candles or Decorations

With reference to the figures, stands for supporting a plurality of candles or decorations will now be described. The stands discussed herein function to support a plurality of candles or other decorations proximate a celebratory item. The stands serve to increase the celebratory impact of the celebratory item and to increase the aesthetic appeal of the celebratory item.

The reader will appreciate from the figures and description below that the presently disclosed stands address many of the shortcomings of conventional stands. For example, the stands described heroin avoid the need to insert the candles or decorations into the celebratory item by supporting the candles and/or decorations near the celebratory item.

Not inserting the candles or decorations into celebratory items provides numerous benefits. For instance, it avoids obscuring or degrading how the celebratory item is decorated. Further, having the candles or decorations near, but not directly on the celebratory item, reduces the risk that candle wax will drip onto the celebratory item. Limiting or eliminating candle wax on the celebratory item limits damage to the decorations, avoids reducing the palatability or appeal of the celebratory item, and avoids the candle wax being ingested. Another benefit of providing separation between the candles and the celebratory item is reducing the spread of germs by a person inadvertently transferring saliva onto the celebratory item when blowing out the candles. See Dawson. Paul, *Bacterial Transfer Associated with Blowing Out Candles on a Birthday Cake*, Journal of Food Research Vol. 6, No. 4 (2017).

Stand Embodiment One

Figure 2:
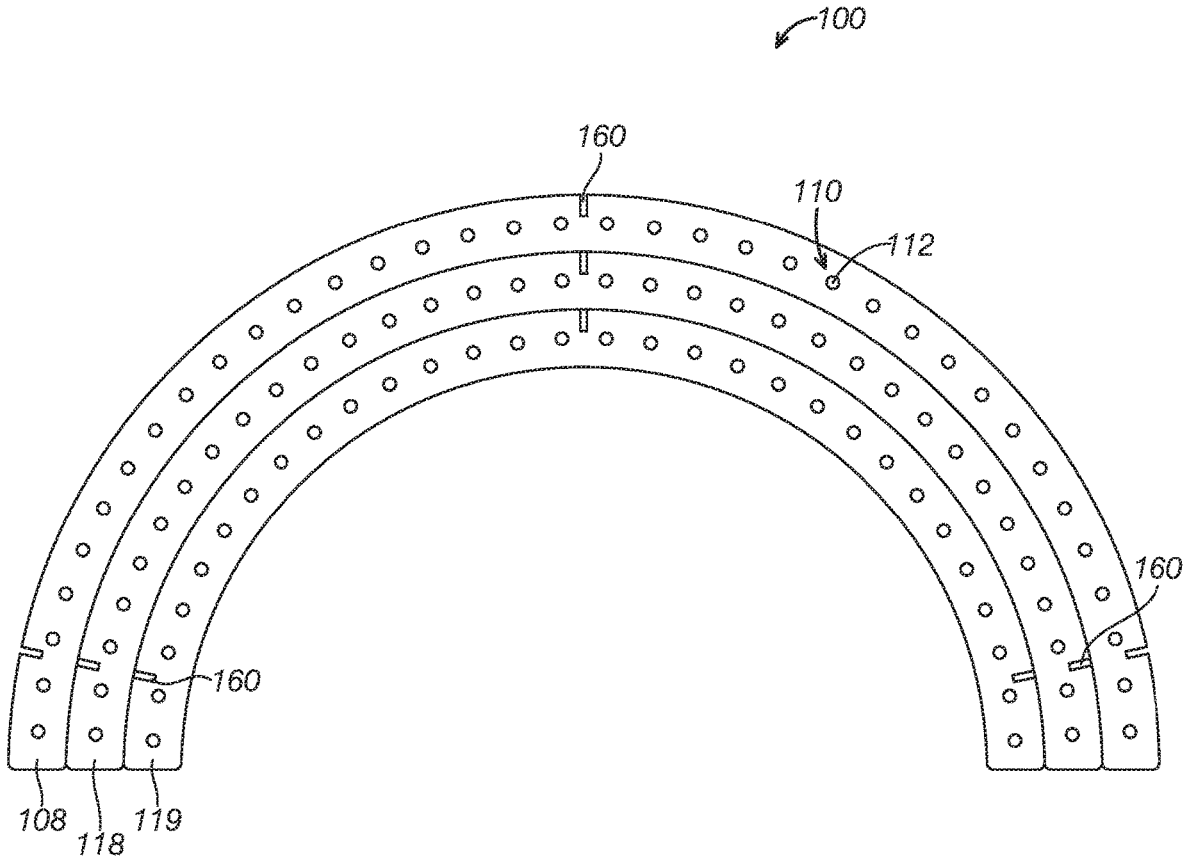
FIG. 2 is a top view of the platforms shown in FIG. 1 removed from the stringers and lying flat in a nested configuration.
Figure 3:
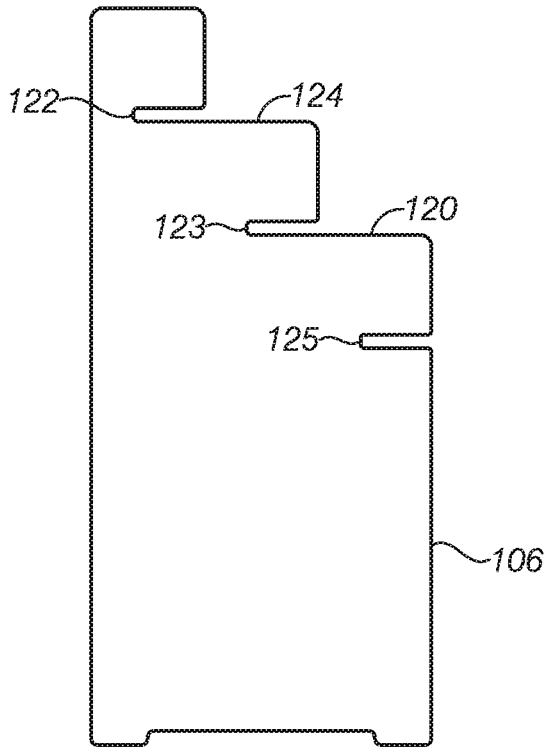
FIG. 3 is a side elevation view of a stringer shown in FIG. 1.

With reference to FIGS. 1-3, a first example of a stand, stand 100, will now be described. Stand 100 includes a first stringer 106, a second stringer 126, a third stringer 127, a first platform 108, a second platform 118, and a third platform 119. As shown in FIG. 1, stand 100 supports plurality of candles 102 proximate celebratory item 104.

In some examples, the stand does not include one or more features included in stand 100. For example, some stand examples do not include second and third stringers. Moreover, some examples do not include second and third platforms.

In other examples, the stand includes additional or alternative features, such as additional platforms, additional stringers, illumination devices, sound devices, and fasteners.

Stringer

In the present example, first stringer 106, second stringer 126, and third stringer 127 are substantially the same. Thus, this discussion will focus on first stringer 106 with the understanding that the features described for it are equally applicable to second stringer 126 and third stringer 127. The reader should appreciate that the stringers may be configured differently and a given stringer may include additional or alternative features than other stringers included in the stand.

As can be seen in FIGS. 1 and 3, stringer 106 is configured to stand upright to support first platform 108, second platform 118, and third platform 119. In particular, stringer 106 is configured to removably support first platform 108, second platform 118, and third platform 119 without tools or fasteners. Stringer 106 supports first platform 108, second platform 118, and third platform 119 in three vertically spaced positions.

With reference to FIGS. 1 and 3, the reader can see that stringer 106 includes a first ledge 124, a second ledge 120, a first slit 122, a second slit 123, and a third slit 125. First ledge 124 and first slit 122 cooperate to support first platform 108. Second ledge 120 and second slit 123 cooperate to support second platform 118. Third slit 125 supports third platform 119. In the present example, the platforms do not extend beyond the slits. In other examples, the platforms extend beyond the slits and the extended portions are supported by the ledges.

In FIGS. 1 and 3, the reader can see that first ledge 124 and first slit 122 are vertically aligned and proximate each other. Second ledge 120 and second slit 123 are proximate and vertically aligned with each other and vertically spaced from first ledge 124 and first slit 122. Third slit 125 is vertically spaced from the first ledge 124 and first slit 122 pair as well as vertically spaced from the second ledge 120 and second slit 123 pair.

Serving to support first platform 108, second platform 118, and third platform 119 in a stadium configuration, second ledge 120 is horizontally spaced from first ledge 124. Further enabling the stadium configuration shown in FIG. 1 is first slit 122 being horizontally spaced from second slit 123 and second slit 123 being horizontally spaced from third slit 125 as shown m FIG. 3. In the present example, the slits serve as backstops for the platforms and thus define the horizontal alignment of the platforms.

First slit 122, second slit 123, and third slit 125 are configured to receive first platform 108, second platform 118, and third platform 119, respectively, in interference fits. First slit 122 is complementary configured with first platform 108 to tightly receive first platform 108 and likewise with regard to the other slits and platforms. The reader can see by comparing FIGS. 1 and 3 that the interference fit between third platform 119 and third slit 123 serves to support third platform 119 without cooperating with a ledge.

As can be seen in FIGS. 1 and 3, stringer 106 is planar with two major faces connected by minor edges. The planar configuration of stringer 106 facilitates flat packing first stringer 106, second stringer 126, and third stringer 127 along with the other planar components of stand 100 when disassembled.

Figure 4:
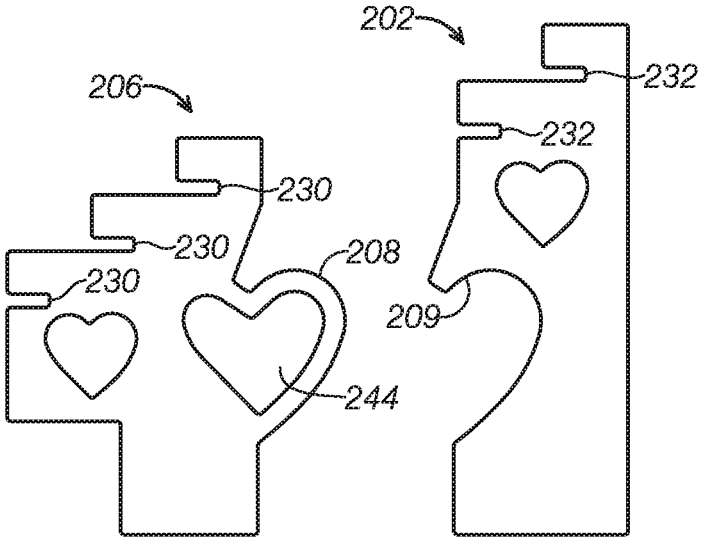
FIG. 4 is a side elevation view of a second example of two stringers, the stringers including ornamentation on their external faces and being complementarily configured with each other.

With brief reference to FIG. 4, the reader can see two alternative stringer embodiments, lower stringer 206 and upper stringer 207. As can be seen in FIG. 4, lower stringer 206 and upper stringer 207 are planar and each includes ornamentation 244 on their major faces. In the present example, the ornamentation is heart shapes, but other examples are ornamented differently.

With continued reference to FIG. 4, the reader can see that lower stringer 206 is configured to support three platforms at three different heights with slits 230. Upper stringer 207 is configured to support two platforms at two different heights with slits 232. Lower stringer 206 supports platforms at lower heights than upper stringer 207 supports platforms. Lower stringer 206 and upper stringer 207 thus cooperate to support five platforms at five different heights and five different horizontal positions. The horizontal positions may be described as radial positions if the platforms are curved.

As shown in FIG. 4, lower stringer 206 and upper stringer 207 are configured to interlock. Lower stringer 206 defines projection 208 complementarity configured with recess 209 defined in upper stringer 207. The interlocking engagement enhances the stability of the stringers and serves to horizontally or radially orient the platforms supported on lower stringer 206 with the platforms supported on upper stringer 207.

Platform

In the example shown in FIGS. 1-3, first platform 108, second platform 118, and third platform 119 function to support plurality of candles 102. As shown in FIGS. 1 and 2, each platform includes a plurality of support points 110 configured to support plurality of candles 102. In the present example, first platform 108 is depicted supporting 18 candles, second platform 118 is depicted supporting 17 candles, and third platform 119 is depicted supporting 13 candles, but these are just representative examples of the number of candles or decorations the platforms may support. In some examples, the platforms support more or fewer candles. The reader can see in FIG. 1 that each platform includes additional support points beyond the number of candles supported to support additional candles if desired. The platforms may be configured with more or less support points than depicted in the present example.

With reference to FIGS. 1 and 2, the reader can see that each support point 110 includes a support opening 112 defined in the platform where it is located. Support opening 112 is complementarily configured with an outer profile of candle 114 to receive a portion of candle 114 in support opening 112. In the present example, support opening 112 tightly receives candle 114 to define an interference fit, which helps hold candle 114 upright and helps resist candle 114 tilting in support opening 112 or falling down.

In the example shown in FIGS. 1-3, each platform is removably supported on stringers 106, 126, and 127. Each platform defines slots 160 configured to receive the stringers.

The reader can further see in FIG. 1 that first platform 108, second platform 118, and third platform 119 are planar, which enables them to be packed flat when removed from the stringers. With the stringers and platforms all being substantially planar, stand 100 is configured to be packed in a relatively flat configuration when its components are disassembled.

Further facilitating space efficient packing, the reader can set in FIG. 2 that first platform 108, second platform 118, and third platform 119 are complementary configured in a nested arrangement. In particular, the outer radius of third platform 119 complements the inner radius of second platform 118 and the outer radius of second platform 118 complements the inner radius of first platform 108. Expressed another way, third platform 119 defines a first curve with a first radius and second platform 118 defines a second curve with a second radius that is larger than the first radius. As shown in FIG. 2, the second curve is concentric with the first curve and the first curve complements the second curve to allow third platform 119 to nest within the second curve of second platform 118 when first platform 108 and second platform 118 lie flat. As shown in FIG. 1, the first curve is configured to at least partially surround celebratory item 104.

The reader can see in FIG. 1 that each platform spans between the circumferentially spaced stringers 106, 126, and 127. In the present example, each platform is cooperatively supported by each stringer. In some examples, a single stringer or two stringers support the platforms instead of three stringers as shown in FIG. 1. In some examples, the platforms are supported by more than three stringers.

With reference to FIGS. 1 and 2, the reader can see that each platform is curved. In other examples, one or more of the platforms is straight or extends in a zig-zag or irregular fashion. As shown in FIG. 1, the curve of the platforms is selected to complement the round outer profile of celebratory item 104. In particular, third platform 119 closely conforms to the circumference of celebratory item 104. As shown in FIGS. 1 and 2, second platform 118 conforms closely to the circumference of third platform 119 and less closely to the circumference of celebratory item 104 than third platform 119. First platform 108 conforms closely to the circumference of second platform 118 and comparatively loosely conforms to the circumference of celebratory item 104.

The reader can see in FIG. 1 that the platforms are configured to at least partially surround celebratory item 104. In some examples, the platforms extend completely around the celebratory item, around some portion less than halfway around of the celebratory item, or around some portion more than halfway around the celebratory item.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A stand for supporting a plurality of candles or decorations proximate a celebratory item, comprising:

a first stringer comprising:

a first slit;

a second slit located below the first slit; and a first ledge that extends outwardly from the first slit and that is vertically aligned with the first slit;

a second stringer spaced from the first stringer and comprising:

a third slit horizontally aligned with the first slit;

a fourth slit located below the third slit and horizontally aligned with the second slit; and a second ledge that extends outwardly from the third slit, that is vertically aligned with the third slit, and that is horizontally aligned with the first ledge;

a first platform that is received within the first slit, and that is supported by the first ledge of the first stringer and second ledge of the second stringer; and a second platform received in the second slit of the first stringer and received in the fourth slit of the second stringer, wherein the second platform is secured within the first slit by an interference fit between the second slit and a corresponding portion of the second platform that is in contact with the second slit, wherein the second platform is secured within the fourth slit by an interference fit between the second slit and a corresponding portion of the second platform that is in contact with the fourth slit, wherein the second platform is supported by the first stringer and by the second stringer in a position vertically spaced from and below the first platform, and wherein the second platform is secured without a presence of a ledge extending outwardly from either the second slit and the fourth slit, wherein the first platform and the second platform:

each include a plurality of support points configured to support the plurality of candles or decorations; and are complementarily configured with the celebratory item to support the plurality of candles or decorations in a position adjacent to the celebratory item, the first platform defines a first curve with a first radius, the first curve configured to surround the celebratory item; and the second platform defines a second curve with a second radius that is larger than the first radius, the second curve being concentric with the first curve.

2. The stand of claim 1, wherein:

the first platform and the second platform are planar; and the first curve complements the second curve to allow the first platform to nest within the second curve of the second platform when the first platform and the second platform lie flat.

3. The stand of claim 2, wherein the first stringer and the second stringer are planar.

4. The stand of claim 1, wherein the first stringer includes an exterior face and the exterior face defines ornamentation.

5. The stand of claim 1, wherein the first platform and the second platform are removably supported on the first stringer and the second stringer.

6. The stand of claim 5, wherein the first platform and the second platform are removably supported on the first stringer and the second stringer via interference fits.

* * * * *